US006123284A

United States Patent [19]

Bichot et al.

[11] Patent Number: 6,123,284

[45] Date of Patent: Sep. 26, 2000

[54] MACHINE FOR WINDING A FIBROUS MAT ON ITSELF

[75] Inventors: Bernard Bichot, Clermont; Bernard Louis, Liancourt, both of France; Hugo Romer, Woms, Germany; Werner Siegel, Osthofen, Germany; Friedrich Kaufmann, Limburgerhof, Germany

[73] Assignee: Isover Saint-Gobain, Courbevoie, France

[21] Appl. No.: 09/147,234

[22] PCT Filed: Mar. 2, 1998

[86] PCT No.: PCT/FR98/00408

§ 371 Date: Mar. 12, 1999

§ 102(e) Date: Mar. 12, 1999

[87] PCT Pub. No.: WO98/40297

PCT Pub. Date: Sep. 17, 1998

[30] Foreign Application Priority Data

Mar. 7, 1997 [FR] France ..... 97 02747

[51] Int. Cl.[7] ..... B65H 18/14

[52] U.S. Cl. ..... 242/541.2; 242/535.1; 242/541.3

[58] Field of Search ..... 242/541.2, 541.3, 242/535.1, 918

[56] References Cited

U.S. PATENT DOCUMENTS

| | | | |
|---|---|---|---|
| 3,464,641 | 9/1969 | Brouwer | 242/541.2 X |
| 4,114,530 | 9/1978 | Miller | 242/541.2 X |
| 4,583,697 | 4/1986 | Bichot et al. . | |
| 4,653,397 | 3/1987 | Gray et al. | 242/541.2 X |
| 4,765,554 | 8/1988 | Tuffal et al. . | |
| 4,789,942 | 12/1988 | Gaertner et al. . | |
| 4,830,808 | 5/1989 | Bichot et al. . | |
| 4,913,764 | 4/1990 | Bichot et al. . | |
| 5,016,833 | 5/1991 | Hamlin | 242/535.1 X |
| 5,305,963 | 4/1994 | Harvey, III et al. | 242/541.2 X |
| 5,425,512 | 6/1995 | Bichot et al. . | |

*Primary Examiner*—Donald P. Walsh
*Assistant Examiner*—William A Rivera
*Attorney, Agent, or Firm*—Oblon, Spivak, McClelland, Maier & Neustadt, P.C.

[57] ABSTRACT

A machine winds a fibrous mat on itself after compressing it. The winding machine has two bands which each embrace about half the circumference of the roll being formed. The machine also includes a plate intended to keep the mat compressed. This plate and, if appropriate, a device for causing compression of the mat are movable and advance downstream as the fibrous mat is wound. In a variation, the compression device is fixed and the plate is lengthened.

5 Claims, 1 Drawing Sheet

MACHINE FOR WINDING A FIBROUS MAT ON ITSELF

BACKGROUND OF THE INVENTION

1. Field of the Invention

The invention relates to the techniques of compressing and then winding fibrous mats in order to make it possible to package and condition them until they reach their place of use. Flexible fibrous mats, especially those which consist of glass wool or rock wool and are intended for insulation, are usually wound on themselves in a very close-packed manner, so as to avoid them occupying too large a volume while being transported. The higher the compression ratio of the mat, the less costly are transport and storage.

2. Description of the Related Art

In general, the production lines operate continuously and deliver mats of uninterrupted length. These mats are cut in order to form rolls, the width and length of which correspond to the user's requirements. On the production lines for mats of insulating wool, there are winding machines which operate in a more or less automated manner.

In order to perform their functions, these machines must have some basic characteristics. They must compress the wool mats as much as possible in the same way over their entire length, but they must also avoid damaging the fibre and binder forming the insulating mat.

Moreover, it is important for all the operations to take place at sufficient speed to be compatible with the speed of travel of the mat. This is a particularly important point as regards modern lines where it is often desirable to increase the production capacity. For this purpose, the number of upstream units producing glass or rock fibres is increased, all these units successively feeding the same mat, the speed of travel of which depends, all else being equal, on the number of machines upstream.

In order to reduce transport costs, high compression ratios must be achieved, without the fibrous mat being damaged.

The rolls of mineral fibre mats, which it is possible to obtain with winding machines of the prior art, are limited, in the case of specific masses of 8 to 10 kg/m$^3$, to compression ratios of less than 7/1, if compression is carried out in a single operation, and to ratios of between 6 and 8/1, with methods comprising two mechanical steps or one mechanical step and one vacuum step.

Existing winding machines are of two types: either the elements between which winding takes place are essentially plane elements or winding takes place within a substantially circular cavity.

Some of the winding machines which use two plane conveyor belts forming a dihedron with an aperture of, for example, 60° and within which the winding of the fibrous mat takes place, employ compression plates.

Thus, European Patent Application Serial No. 672 014 employs a double device both for causing the compression of the mat and for making winding easier. On the one hand, a conveyor band and, on the other hand, a plate are used. The conveyor band is not, as is customary, carried and driven by two rollers, but the second roller is replaced by a cylinder of small diameter, thus making it possible to introduce the conveyor a long way between the last turn and the mat portion following the latter. The device comprises, moreover, a plate which ensures that the mat is both compressed and held in the compressed state.

These two elements, namely the < tapered > conveyor and plate, are rigidly connected and move away upstream of the approaching mat as the roll increases in diameter.

European Patent Application Serial No. 374 985 has likewise provided a plate associated with a band conveyor. Its function is merely to maintain the compression produced by the conveyor band which it succeeds. Here too, the assembly is associated rigidly and advances upstream when the roll being formed increases in size.

European Patent No. 551 228 describes a winding machine intended for winding a fibrous mat on itself. It is of the type which employs two belts surrounding the entire roll being formed; it comprises means for compressing the fibrous mat, such as two plane band conveyors, which approach one another, thereby forming a dihedron of small aperture. The essential feature of this winding machine is two belts of which one embraces substantially half the circumference of the roll being formed and the other a large part of the rest. The winding speed and the compression ratio possible without the fibrous mats being damaged are excellent. It became clear, however, that it was still possible to improve the operation of the preceding winding machine.

As described in European Patent No. 551 228, the winding machine has, in fact, an exemplary embodiment in which the state of compression of the fibrous mat, compressed by the two band conveyors mentioned above, is maintained by means of a plate. In fact, the mat is compelled to slide under the plate which is parallel to the conveyor supporting the already compressed mat. Among the variants of the prior winding machine which have been presented, the one comprising the sliding plate is an improvement when compared with the other variants. However, this plate fully performs its function only at the commencement of winding; when the roll increases in size, the distance between the end of the plate and the already formed first turn of the roll increases, and this may allow some decompression of the mat.

The technique of the invention was developed in order to overcome this slight disadvantage.

SUMMARY OF THE INVENTION

One object of the invention is to provide fibrous mats which are wound on themselves with high compression ratios and which, on decompression, recover their original characteristics.

One object of the invention is also to provide a winding machine which does not damage the fibers and binder of the fibrous mat in any way during compression.

The invention relates to winding machines of the type which, for pressing on the fibrous roll, employs either one free belt or two belts which form a kind of circular cavity around the roll;

The invention provides a winding machine for winding a fibrous mat on itself, the said winding machine comprising, in particular, means for compressing the mat in translational motion, with a device, such as a plate, for keeping the mat compressed, as well as two belts, of which one embraces substantially half the circumference of the roll being formed and the other a substantial part of the other half, in which winding machine the device keeping the mat compressed is movable and capable of being displaced downstream as the roll is wound.

The solution of the invention makes it possible to benefit from the effect of the plate both at the commencement and at the end of the winding operation.

In a variant, the compression means, located on the same side as the device keeping the mat compressed, is likewise movable and capable of being displaced downstream as the roll is wound, and, preferably, the compression means and the device for keeping the mat compressed are integral with one another.

BRIEF DESCRIPTION OF THE DRAWINGS

The figures and the following description will make it possible to understand the operation and advantages of the invention.

DETAILED DESCRIPTION OF THE INVENTION

Figure 1:
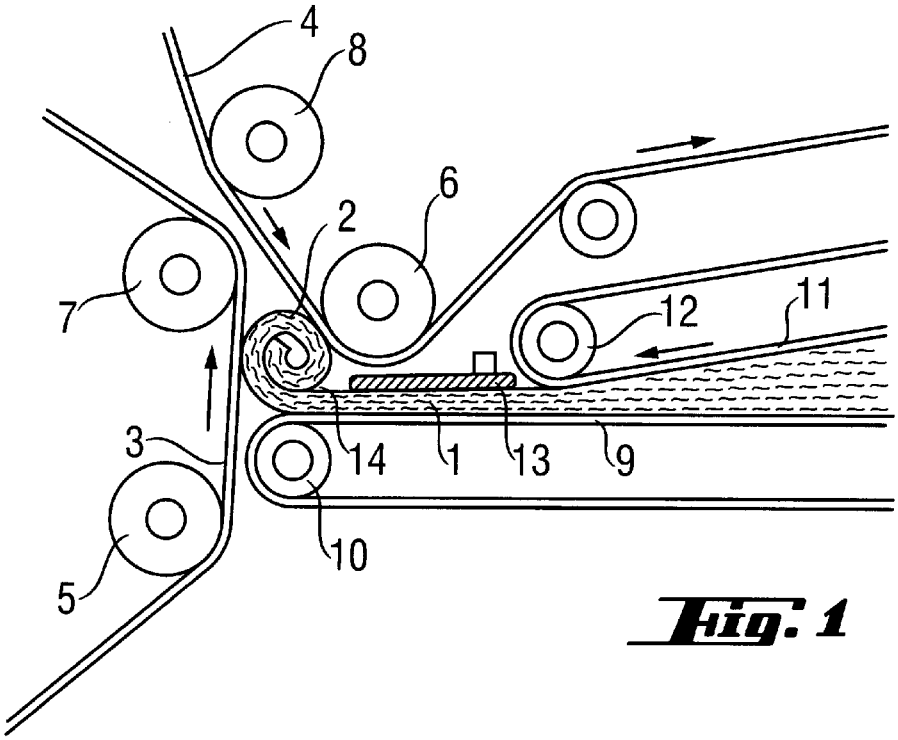
FIG. 1 shows the device for maintaining compression and the associated compression means in the upstream position.
Figure 2:
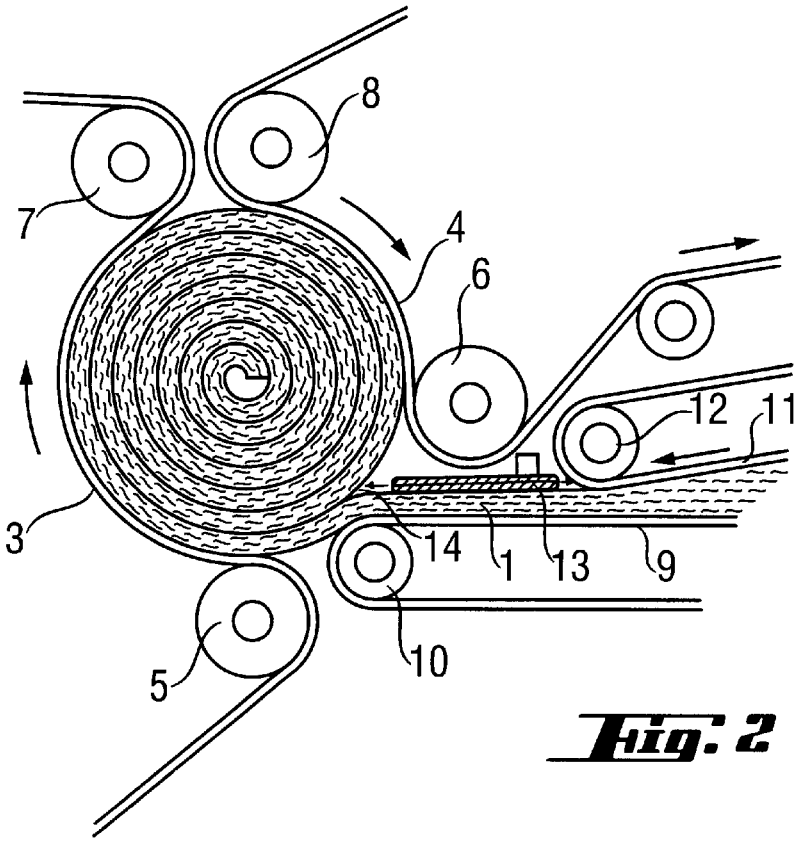
FIG. 2 shows these same elements in the downstream position.

In FIG. 1, the roll 2 of the compressed fibrous mat 1 begins to be formed the belts 3 and 4 driven and/or guided by the fixed rollers 5 and 6 and the movable rollers 7 and 8. The operation of the winding machine of FIGS. 1 and 2 is explained fully in European Patent No. 551 228. The fibrous mat 1 is compressed as a result of the paired action of two belt conveyors, the lower conveyor 9 driven and/or guided by the roller 10 (this assembly not changing its position during winding) and the upper conveyor 11 driven and/or guided by the roller 12. This upper assembly, which forms a means of compressing the fibrous mat, may be movable, on the one hand, perpendicularly to the mat 1 in order to modify its final thickness, and, on the other hand, in the direction of displacement of the mat 1 in order to make it easier for the latter to be wound.

FIG. 1 also illustrates a plate 13 which forms an example of the device for keeping the mat 1 in its compressed state. This plate 13 is preferably located immediately downstream of the roller 12 which is at the end of the upper conveyor 11, so as to avoid intermediate decompression of the mat.

While the compressed mat 1 is being wound, its center moves away from the fixed roller 6, while its curvature decreases. The result of this double phenomenon is that this same fixed roller 6 moves away from the contact line 14 between the last turn being formed and the preceding turn. The invention therefore provides for displacing the plate 13 in order to bring it nearer to this contact line 14.

FIG. 2 shows the situation of the various elements of the winding machine after the displacement of the plate 13 following the winding of the compressed mat.

The figure illustrates the plate 13 and the upper conveyor 11 as being integral, that is to say that they are displaced simultaneously downstream during winding.

The scope of the invention is not exceeded if, while the upper conveyor 11 remains fixed, only the plate 13 approaches the roll being formed. In this case, it will have been possible to avoid decompressing the compressed mat 1 by lengthening the plate 13, one end of which remains in the vicinity of the roller 12, while the other end remains near the contact line 14. This plate 13 of variable length consists, for example, of two parts which partially overlap and slide relative to one another.

What is claimed is:

1. Winding machine for winding a fibrous mat on itself, said winding machine comprising:

a compression device which acts to compress the mat in translational motion, with a plate for keeping the mat compressed, and two belts of which one embraces substantially half the circumference of a roll being formed and the other a substantial part of the other half, wherein the plate keeping the mat compressed is movable and capable of being displaced downstream as the roll is wound, said plate having two parts which partially overlap and slide relative to one another.

2. Winding machine according to claim 1, wherein the compression device, located on the same side as the plate keeping the mat compressed, is likewise movable and capable of being displaced downstream as the roll is wound.

3. Winding machine according to claim 2, wherein the compression device and the plate for keeping the mat compressed are integral with one another.

4. Winding machine according to claim 1, wherein the compression device is fixed, and further wherein the plate for keeping the mat compressed is lengthened as the roll is wound.

5. Winding machine according to claim 1, wherein the compression device and the plate for keeping the mat compressed are displaced simultaneously downstream during winding.

* * * * *